US007570899B2

(12) United States Patent
Park

(10) Patent No.: US 7,570,899 B2
(45) Date of Patent: Aug. 4, 2009

(54) CHARGING ROLLER CLEANING DEVICE AND IMAGE FORMING APPARATUS INCLUDING THE SAME

(75) Inventor: Jong-hyun Park, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 134 days.

(21) Appl. No.: 11/646,388

(22) Filed: Dec. 28, 2006

(65) Prior Publication Data

US 2007/0280724 A1 Dec. 6, 2007

(30) Foreign Application Priority Data

Jun. 5, 2006 (KR) ..... 10-2006-0050460

(51) Int. Cl.
*G03G 15/02* (2006.01)

(52) U.S. Cl. ..... 399/100; 399/176

(58) Field of Classification Search ..... 399/100, 399/99, 176, 349, 343; 15/256.5, 256.51, 15/256.52

See application file for complete search history.

(56) References Cited

U.S. PATENT DOCUMENTS

| | | | | |
|---|---|---|---|---|
| 5,659,853 | A * | 8/1997 | Matsuda et al. | 399/176 |
| 6,381,432 | B1 | 4/2002 | Hattori | 399/176 |
| 6,816,700 | B2 * | 11/2004 | Hatano | 399/349 |
| 7,317,883 | B2 | 1/2008 | Watanabe et al. | 399/100 |
| 2002/0009316 | A1 * | 1/2002 | Endo et al. | 399/349 |
| 2006/0115292 | A1 | 6/2006 | Sampe et al. | 399/100 |
| 2006/0291903 | A1 * | 12/2006 | Watanabe et al. | 399/149 |

FOREIGN PATENT DOCUMENTS

| | | | |
|---|---|---|---|
| CN | 1892474 | | 1/2007 |
| JP | 58-194061 | A * | 11/1983 |
| JP | 11-65346 | | 3/1999 |
| JP | 11-167306 | | 6/1999 |
| JP | 2000-122458 | | 4/2000 |
| JP | 2000-231320 | | 8/2000 |
| KR | 2006-9210 | | 1/2006 |

OTHER PUBLICATIONS

Office Action issued in corresponding Korean Patent Application No. 2006-0050460 dated Dec. 27, 2007.
Office Action issued in Korean Patent Application No. 2006-50460 on Jul. 24, 2007.
Search Report issued in European Patent Application No. 07101225.6 on Sep. 28, 2007.
Notice of Allowance issued in Korean Patent No. 2006-50460 on May 29, 2008.
Office Action issued in Chinese Patent Application No. 2007100083004 on Oct. 31, 2008.

* cited by examiner

*Primary Examiner*—Sophia S Chen
(74) *Attorney, Agent, or Firm*—Stein McEwen, LLP

(57) ABSTRACT

A charging roller cleaning device is provided for removing impurities attached on a charging roller that charges a photosensitive medium to a uniform electric potential. Such a cleaning device includes: a cleaning roller arranged to rotate, while contacting the charging roller to remove the impurities attached on the charging roller; and a cleaning member arranged to scrap off impurities attached on the cleaning roller.

15 Claims, 3 Drawing Sheets

CHARGING ROLLER CLEANING DEVICE AND IMAGE FORMING APPARATUS INCLUDING THE SAME

CROSS-REFERENCE TO RELATED APPLICATIONS

This application claims all benefits accruing under 35 U.S.C. §119 from Korean Patent Application No. 2006-50460, filed on Jun. 5, 2006, in the Korean Intellectual Property Office, the disclosure of which is incorporated herein by reference.

BACKGROUND OF THE INVENTION

1. Field of the Invention

The present invention relates to a charging roller cleaning device and an image forming apparatus including the charging roller cleaning device, and more particularly, to a charging roller cleaning device removing impurities attached on a charging roller and preventing the charging roller from being contaminated by the removed impurities and an image forming apparatus including the charging roller cleaning device.

2. Related Art

Image forming apparatuses using an electro-photographic process, such as laser beam printers, photo-copiers, facsimile machines and multi-functional products, are apparatuses for forming images by charging a photosensitive medium to have a uniform electric potential using a charging roller, scanning light modulated to correspond to image information onto the photosensitive medium using an optical scanning unit to form an electrostatic latent image on the photosensitive medium, supplying a toner to the electrostatic latent image using a developing unit to form a toner image, transferring the toner image to a printable medium, and fusing the toner image onto the printable medium by heating the toner image to form an image on the printable medium.

After performing the above charge, exposure, development, and transferring processes, waste toner remaining on a photosensitive drum is removed by a cleaning device. In this process, impurities such as silica having small particle diameters and paper dust included in the toner may not be removed. When these impurities are attached onto the charging roller, the photosensitive drum cannot be charged uniformly and a defective printing can occur. In addition, the impurities attached on the charging roller may become securely fused on the photosensitive drum.

SUMMARY OF THE INVENTION

Several aspects and example embodiments of the present invention provide a charging roller cleaning device that is capable of removing impurities attached on a charging roller and preventing the charging roller from being contaminated by the removed impurities, and an image forming apparatus including the charging roller cleaning device.

Additional aspects and/or advantages of the invention will be set forth in part in the description which follows and, in part, will be obvious from the description, or may be learned by practice of the invention.

In accordance with an example embodiment of the present invention, there is provided a charging roller cleaning device for removing impurities attached on a charging roller that charges a photosensitive medium to a uniform electric potential. Such a charging roller cleaning device comprises: a cleaning roller arranged to rotate, while contacting the charging roller to remove the impurities on the charging roller; and a cleaning member arranged to scrape off impurities attached on the cleaning roller.

According to an aspect of the present invention, the cleaning device may further include: a blocking member located between the cleaning member and the charging roller to block the impurities that are scattered by the cleaning member so as not to contaminate the charging roller. The blocking member may be formed of a material having lower elasticity than the material forming the cleaning member.

According to an aspect of the present invention, the cleaning device may further include: a housing, in which the cleaning member is installed, forming a first receiving space receiving the impurities. The blocking member may form a second receiving space receiving the impurities with an outer circumference of the cleaning roller and the housing.

According to an aspect of the present invention, the cleaning member may be installed so that a front edge of the cleaning member contacting the outer circumference of the cleaning roller is angled towards a forward direction of rotation of the cleaning roller.

In accordance with another example embodiment of the present invention, there is provided an image forming apparatus including: a charging roller for charging a photosensitive medium to a uniform electric potential; a light scanning unit for forming an electrostatic latent image on the photosensitive medium; a developing unit for supplying a toner to the electrostatic latent image to develop the image; and a charging roller cleaning device for cleaning the charging roller, wherein the charging roller cleaning device includes: a cleaning roller arranged to rotate, while contacting the charging roller to remove impurities attached on the charging roller; and a cleaning member arranged to scrape off impurities attached on the cleaning roller.

According to an aspect of the present invention, the developing unit may develop the electrostatic latent image using a two-component developing method.

In accordance with yet another example embodiment of the present invention, a removable cartridge for use in an image forming apparatus is provided to remove impurities attached on a charging roller disposed in the image forming apparatus. Such a removable cartridge comprises a housing; a cleaning roller disposed in the housing to rotate along with the charging roller, while contacting the charging roller so as to remove the impurities on the charging roller; and a cleaning member disposed in the housing to scrape off impurities attached on the cleaning roller.

According to an aspect of the present invention, the cleaning member is a thin plate-shaped member having a rear edge supported by the housing and a front edge in contact with an outer circumference of the cleaning roller, and is arranged at an angle toward a rotating direction of the cleaning roller so as to form a first receiving space in the housing for receiving the impurities removed from the charging roller.

According to an aspect of the present invention, a blocking member is further disposed between the cleaning member and the charging roller, to block the impurities that are scattered by the cleaning member, so as not to contaminate the charging roller. Such a blocking member is a thin plate-shaped member having a rear edge supported by the housing and a front edge in proximity with an outer circumference of the cleaning roller, and is arranged at an angle toward a rotating direction of the cleaning roller so as to form a second receiving space in the housing for receiving the impurities scattered from the cleaning member.

According to another aspect of the present invention, the cleaning member is installed so that a front edge of the cleaning member contacting the outer circumference of the cleaning roller is angled towards a forward direction of rotation of the cleaning roller.

According to another aspect of the present invention, the blocking member may be formed of a material having lower elasticity than the material forming the cleaning member. Both the cleaning member and the block member may be formed of a rubber, a polyethylene terephthalate (PET), or an urethane.

In addition to the example embodiments and aspects as described above, further aspects and embodiments will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EMBODIMENTS

Figure 1:
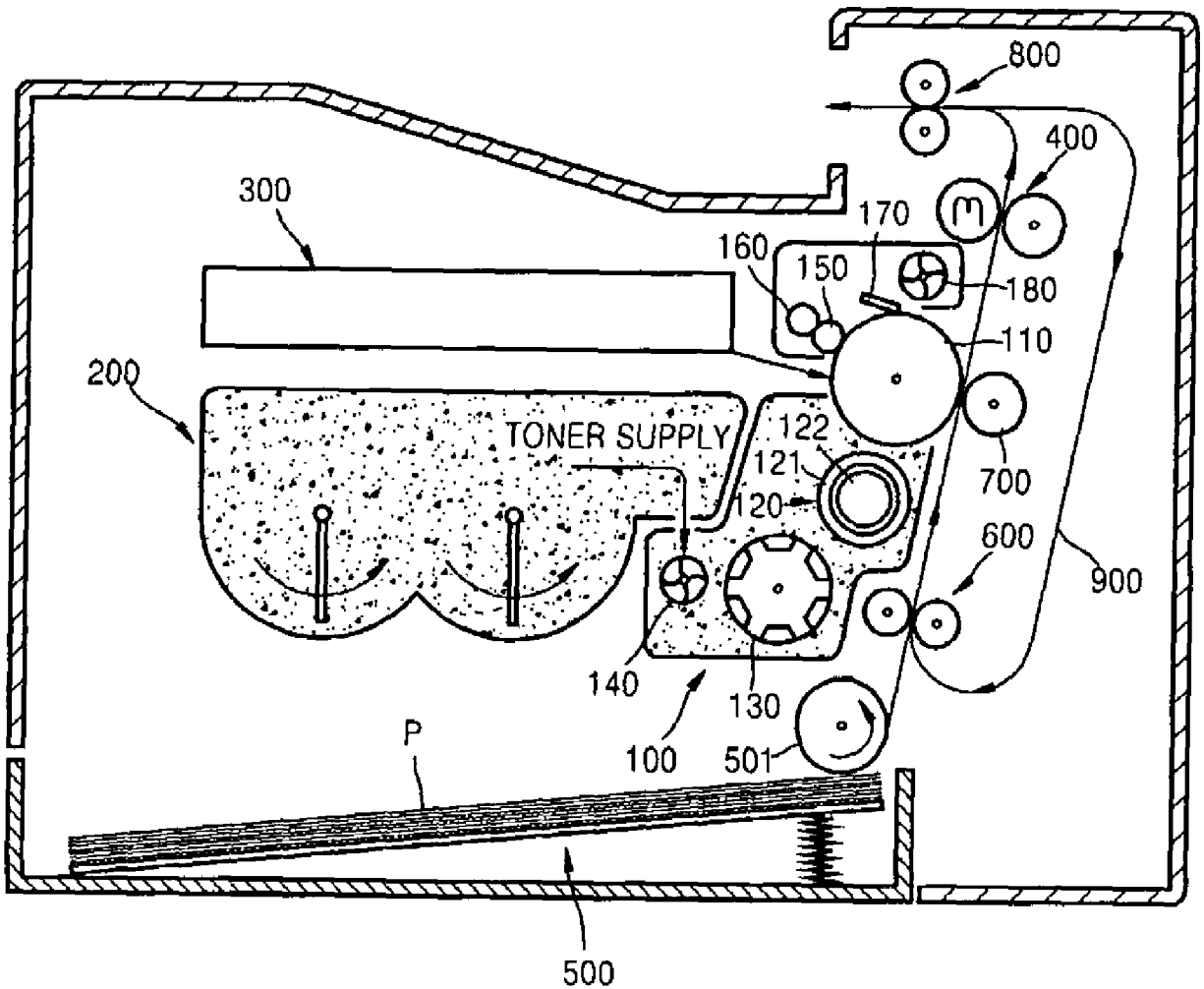
FIG. 1 is a cross-sectional diagram of an image forming apparatus according to an example embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

The present invention will now be described more fully with reference to the accompanying drawings, in which exemplary embodiments of the invention are shown.

FIG. 1 is a cross-sectional diagram of an image forming apparatus according to an example embodiment of the present invention. Referring to FIG. 1, a photosensitive drum 110 is an example of a photosensitive medium, and is obtained by forming a photosensitive layer of a predetermined thickness on an outer circumferential surface of a cylindrical metal pipe. Alternatively, a photosensitive belt can also be used as another example of the photosensitive medium. A charging roller 150 is a charger that rotates by contacting the photosensitive drum 110 to charge a surface of the photosensitive drum 110 to a uniform electric potential. A charge bias (Vc) is applied to the charging roller 150.

A light scanning unit 300 scans a light that is modulated according to image information onto the photosensitive drum 110 that is charged to have the uniform electric potential. As a result, an electrostatic latent image is formed. A laser scanning unit (LSU) including a laser diode (LD) as a light source can be used as the light scanning unit 300.

A developing unit 100 includes the photosensitive drum 110 and a developing roller 120. The developing roller 120 rotates, while facing the photosensitive drum 110. In a developing unit adopting a one-component developing method, the developing roller 120 may contact the photosensitive drum 110 or may be separated a predetermined distance from the photosensitive drum 110. In a developing unit adopting a two-component developing method, the developing roller 120 is separated a predetermined distance (for example, a few hundreds of μm) from the photosensitive drum 110. The above distance is referred to as a developing gap. In the current example embodiment of the present invention, the developing unit 100 adopting the two-component developing method will be described. The developing roller 120 includes a sleeve 121 rotating around a magnet 122, and thus, is referred to as a magnet roller.

A toner supplied from a toner unit 200 to the developing unit 100 is agitated with a magnetic carrier using an auger 140 and a mixer 130 installed in the developing unit 100 and is charged by friction. Shapes of the auger 140 and the mixer 130 are not limited to the examples shown in FIGS. 1 and 2; however, such an auger 140 and a mixer 130 can be any type, size or shape, as long as they can move and agitate the toner and the magnetic carrier. The carrier is attached onto a surface of the sleeve 121 by the magnetic force of the magnet 122, and the toner is attached onto a surface of the magnetic carrier by the electrostatic force. A developing bias (Vd) is applied to the developing roller 120. When the sleeve 121 rotates, a magnetic brush formed by the magnetic carrier and the toner is moved to the developing gap where the photosensitive drum 110 and the developing roller 120 face each other. The toner is then separated from the carrier by the developing bias Vd and attached to the electrostatic latent image formed on the photosensitive drum 110.

A transfer roller 700 is located to face the photosensitive drum 110 to form a transfer nip. A transfer bias (Vt) is applied to the transfer roller 700 for transferring the toner image attached on the photosensitive drum 110 onto a printable medium, such as a sheet of paper R A crona transfer device may be used instead of the transfer roller 700. Each sheet of paper P is picked up by a pickup roller 501 from a feed cassette 500 and then conveyed, via a feed roller 600 to the photosensitive drum 110 at a predetermined printing speed. When the paper P passes through the transfer nip between the transfer roller 700 and the photosensitive drum 110, the toner image is transferred from the photosensitive drum 110 to the paper P by the transfer bias Vt.

A fusing unit 400 applies heat and pressure onto the paper P and the toner image to fuse the toner image on the paper P. The paper P is discharged by a discharge roller 800. In a case where a duplex-printing is performed, before an edge of the paper P, a surface of which includes a printed image, passes the discharge roller 800 after passing through the fusing unit 400, the discharge roller 800 is reversely rotated. The paper P is conveyed to the feed roller 600 along a duplex-printing path 900. Here, a rear surface of the paper P faces the photosensitive drum 110. Therefore, when the paper P passes through the transfer nip and the fusing unit 400, the image is printed on the rear surface of the paper P. The paper P is discharged by the discharge roller 800.

Referring to FIG. 1, the toner that is not transferred to the paper P remains on the surface of the photosensitive drum 110 that passes through the transfer nip. The remaining toner is removed by a cleaning member 170 that contacts the surface of the photosensitive drum 110, and the removed toner is conveyed to a waste toner container (not shown) by a waste toner conveying unit 180.

Various kinds of external additives are contained in the toner. External additives having small particles, such as small-particle silica, may not be completely removed by the cleaning member 170. In addition, paper dust or fine dust may not be completely removed by the cleaning member 170. In particular, the performance of the cleaning member 170 is degraded due to a long time usage. As a result, it is much more difficult to completely remove the fine dust. The impurities on the photosensitive drum 110 are attached onto the charging roller 150 that rotates while contacting the photosensitive drum 110, and thus, contaminate the surface of the charging roller 150. When the surface of the charging roller 150 is contaminated, it is difficult to charge the surface of the photosensitive drum 110 uniformly. That is, portions of the photosensitive drum 110 contacting the contaminated charging roller 150 cannot be charged to sufficient electric potential, and thus, a printing quality may be degraded.

In order to prevent the charging roller 150 from being contaminated, a cleaning roller 160 is disposed to remove the impurities on the charging roller 150. The cleaning roller 160 is arranged to rotate, while contacting the surface of the charging roller 150. A porous cleaning layer formed of a sponge, or a foam, is formed on a surface of the cleaning roller 160. The impurities removed from the charging roller 150 are received in the porous cleaning layer of the cleaning roller 160.

However, if the toner contains a large amount of external additives of small particles or the toner is used for a long time, the amount of impurities removed from the charging roller 150 increases and exceeds the impurity receiving capacity of the porous cleaning layer on the cleaning roller 160. Then, the impurities are moved from the cleaning roller 160 to the charging roller 150, thus contaminating the charging roller 150. In addition, the impurities may be moved to the photosensitive drum 110 through the charging roller 150, and thus, the photosensitive drum 110 may be contaminated. The contamination of the charging roller 150 or the photosensitive drum 110 due to the impurities results in a defective printed image quality.

Therefore, the image forming apparatus according to the current example embodiment of the present invention includes a charging roller cleaning device that can remove the impurities on the cleaning roller 160. Specifically, FIG. 2 is a cross-sectional diagram of a charging roller cleaning device according to an example embodiment of the present invention, and FIG. 3 is a diagram illustrating an example arrangement of a cleaning member and a blocking member in the cleaning device shown in FIG. 2.

Figure 2:
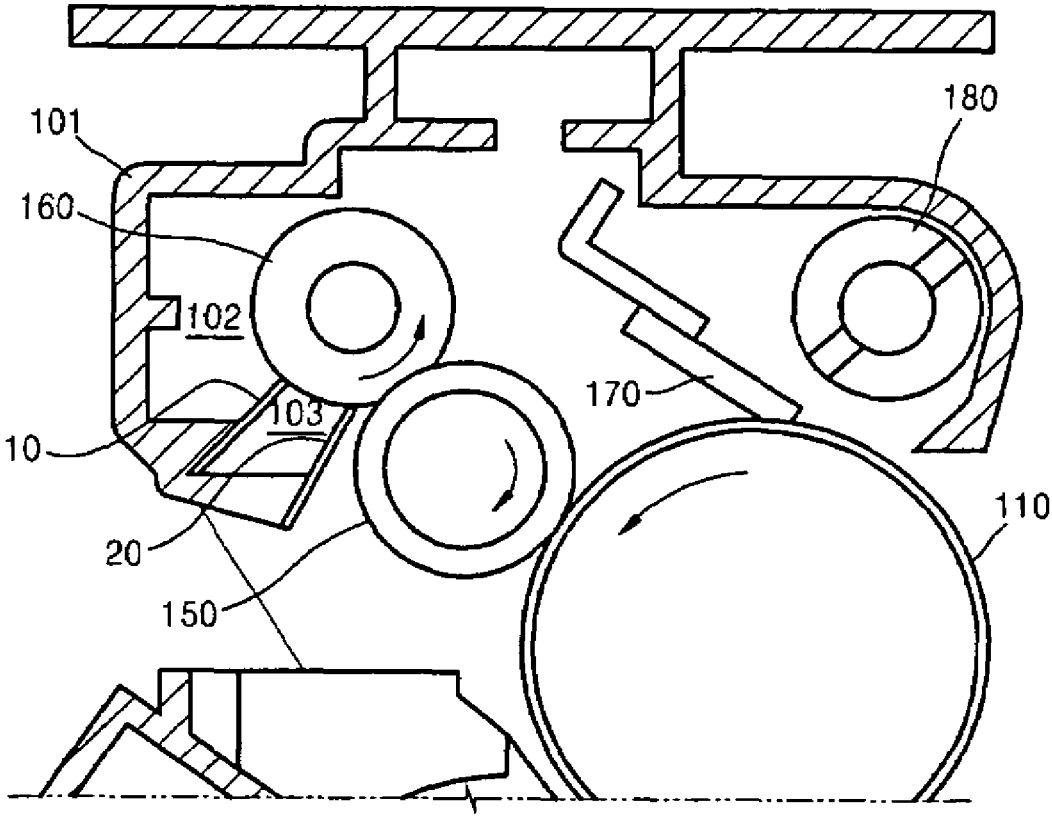
FIG. 2 is a cross-sectional diagram of a charging roller cleaning device according to an example embodiment of the present invention.
Figure 3:
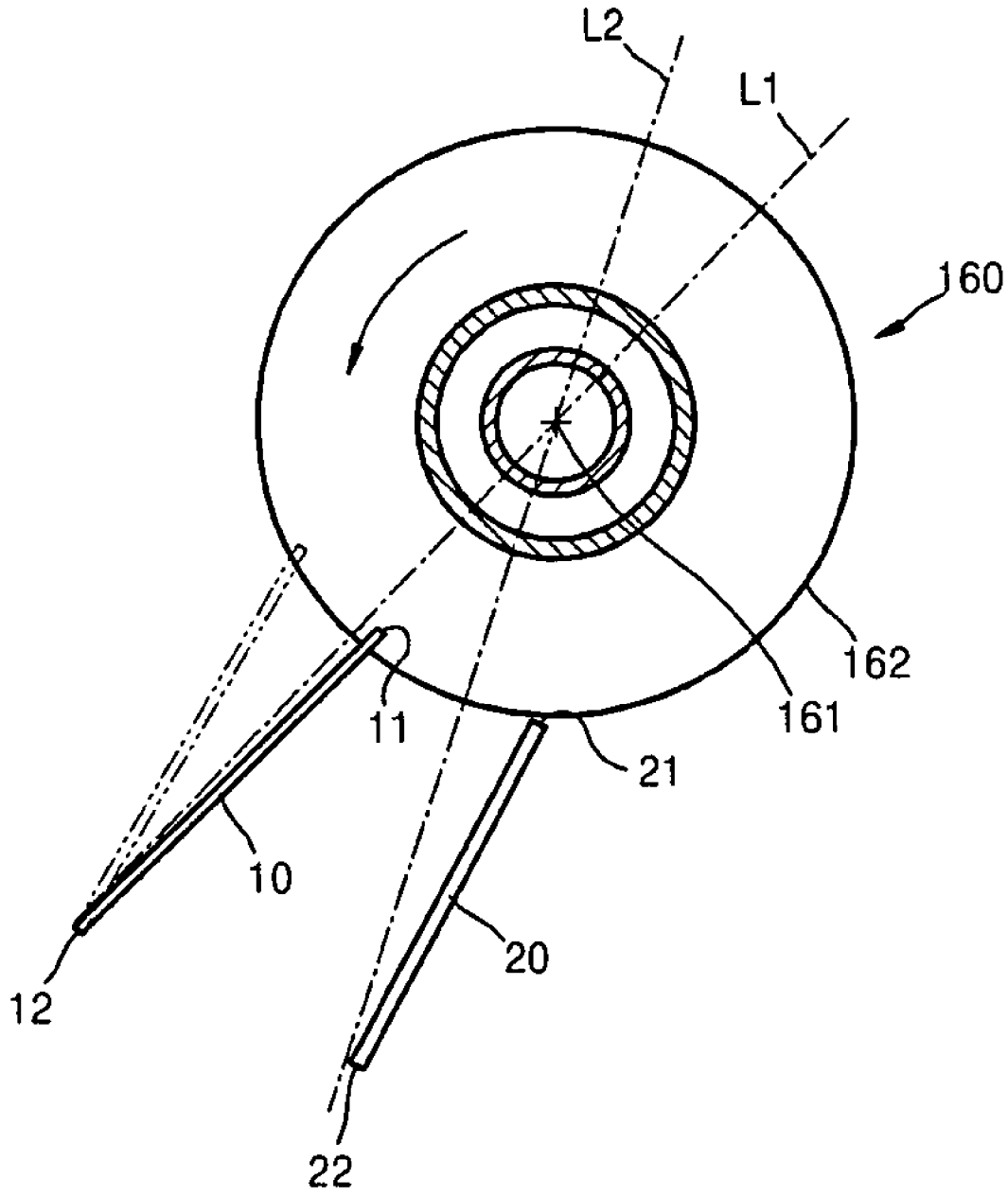
FIG. 3 is a diagram illustrating an example arrangement of a cleaning member and a blocking member in the cleaning device shown in FIG. 2.

Referring to FIGS. 2 and 3, the charging roller cleaning device includes a cleaning member 10 arranged to scrape off the impurities contained in, or deposited on the cleaning roller 160. Such a cleaning member 10 can be a cleaning blade, or alternatively can be a thin plate shape member formed of a rubber, a polyethylene terephthalate (PET), or an urethane. A front edge 11 of the cleaning member 10 contacts an outer circumference 162 of the cleaning roller 160. A rear edge 12 of the cleaning member 10 is supported by a housing 101. Referring to FIG. 3, a length of the cleaning member 10 can be formed so that the front edge 11 of the cleaning member 10 may slightly overlap with the outer circumference 162 of the cleaning roller 160. In addition, the cleaning member 10 may not be in parallel with a straight line L1 that connects an end portion (the rear edge 12 shown in FIG. 3) of the cleaning member 10 to a center 161 of the cleaning roller 160. Also, the front edge 11 of the cleaning member 10 may be angled toward a rotating direction of the cleaning roller 160 from the straight line L1. That is, the front edge 11 may be angled toward a forward direction of the rotating direction of the cleaning roller 160. As shown in FIG. 3, if the front edge 11 of the cleaning member 10 faces a backward direction of the rotating direction of the cleaning roller 160, it may damage the surface of the cleaning roller 160.

According to the structure shown in FIG. 2, the impurities removed from the cleaning roller 160 by the cleaning member 10 are received or deposited in a first receiving space 102 formed by the housing 101. Therefore, the impurity containing capacity of the cleaning roller 160 can be maintained for a long time, and thus, the contaminations of the charging roller 150 and the photosensitive drum 110 and the defective printing can be prevented.

In addition, referring to FIGS. 2 and 3, a blocking member 20 may be installed between the cleaning member 10 and the charging roller 150. An end portion 22 of the blocking member 20 is supported by the housing 101. A front edge 21 of the blocking member 20 may contact the outer circumference 162 of the cleaning roller 160, or may be separated a predetermined distance from the outer circumference 162 of the cleaning roller 160. In a case where the front edge 21 of the blocking member 20 contacts the outer circumference 162 of the cleaning roller 160, the blocking member 20 may not be parallel to a straight line L2 that connects an end portion (end portion 22 shown in FIG. 3) to the center 161 of the cleaning roller 160. In addition, the front edge 21 of the blocking member 20 may be located toward the rotating direction of the cleaning roller 160 based on the straight line L2. That is, the front edge 21 of the blocking member 20 faces a forward direction of the rotating direction of the cleaning roller 160. A thin plate shape member formed of a rubber, a PET, or a urethane can be used as the blocking member 20. In addition, in order to prevent any impurities from scattering due to the blocking member 20, an elasticity of the blocking member 20 may be sufficiently smaller than that of the cleaning member 10.

During the process of removing the impurities of the cleaning roller 160 using the cleaning member 10, the impurities can be scattered. Most of the impurities can be received in the first receiving space 102 in the housing 101. However, some of the impurities can be scattered toward the charging roller 150. The blocking member 20 is located between the cleaning member 10 and the charging roller 150 to prevent the scattered impurities from contaminating the charging roller 150. The arrangement of the blocking member 20 relative to the cleaning member 10 forms a second receiving space 103 with the outer circumference 162 of the cleaning roller 160 and the housing 101. The scattered impurities are received in the second receiving space 103. Therefore, contamination of the charging roller 150 by the impurities that are scattered during the removing process by the cleaning roller 160 can be prevented.

In the above example embodiment, one cleaning member 10 is installed; however, the present invention is not limited thereto, and two or more cleaning members 10 can be installed to remove impurities on the cleaning roller 160. In addition, a plurality of blocking members 20 can also be installed to prevent scattered impurities from contaminating the charging roller 150. Also, in the above example embodiment, the image forming apparatus including the developing unit 100 adopting the two-component developing method is described; however, the charging roller cleaning device according to an example embodiment of the present invention can be applied to the image forming apparatus adopting the developing unit of the one-component developing method. In addition, in the above example embodiment, the developing unit 100 and the toner unit 200 are separated each other so that the toner unit 200 can be replaced; however, the charging roller cleaning device can be applied to an image forming apparatus, in which the developing unit and the toner unit are formed integrally with each other. Furthermore, the cleaning member 10 and the blocking member 20 included in the charging roller cleaning device, shown in FIG. 2, can be arranged in a removable cartridge having a housing 101, as described in connection with FIG. 2 and FIG. 3, for use in an image forming apparatus, shown in FIG. 1. In addition, the charging roller 110 may also be included in the removable cartridge, shown in FIG. 2.

In the charging roller cleaning device and the image forming apparatus including the cleaning device according to an example embodiment of the present invention, the cleaning performance of the cleaning roller that cleans the charging roller can be maintained for a long time. As a result, the contamination of the charging roller due to the impurities can be prevented effectively, and a good printing quality can be maintained. The present invention helps increase the lifespan of the developing unit in the image forming apparatus adopting the two-component developing method, by which the developing unit can be used for a long time while replacing the toner unit. That is, costs for replacing supplies can be reduced, and thus, costs for printing each sheet of paper can be reduced. Then, higher competitiveness in the market of the image forming apparatuses can be obtained.

While there have been illustrated and described what are considered to be example embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. For example, a charging roller 150, as shown in FIG. 2, may be arranged differently relative to a photosensitive body. As a result, a housing of a charging roller cleaning device, as shown in FIG. 2, may be arranged and structured differently, as long as a cleaning mechanism is utilized herein. In addition, as previously discussed, one or more cleaning members and block members can be arranged differently, as long as impurities on the charging roller are contained in the manner as described. Accordingly, it is intended, therefore, that the present invention not be limited to the various example embodiments disclosed, but that the present invention includes all embodiments falling within the scope of the appended claims.

What is claimed is:

1. A cleaning device for removing impurities attached on a charging roller used to charge a photosensitive medium to a uniform electric potential, the cleaning device comprising:

a cleaning roller arranged to rotate along with the charging roller, while contacting the charging roller so as to remove the impurities on the charging roller;

a cleaning member arranged to scrape off impurities attached on the cleaning roller; and a blocking member arranged between the cleaning member and the charging roller, to block the impurities that are scattered by the cleaning member, so as not to contaminate the charging roller, wherein the blocking member is formed of a material having lower elasticity than the material forming the cleaning member.

2. The cleaning device of claim 1, further comprising:

a housing, in which the cleaning member is installed, forming a first receiving space receiving the impurities.

3. The cleaning device of claim 2, wherein the blocking member is arranged relative to the cleaning member, so as to form a second receiving space between the cleaning member and the block member for receiving the impurities with an outer circumference of the cleaning roller and the housing.

4. The cleaning device of claim 2, wherein the cleaning member is installed so that a front edge of the cleaning member contacting the outer circumference of the cleaning roller is angled towards a forward direction of rotation of the cleaning roller.

5. An image forming apparatus comprising:

a charging roller to charge a photosensitive medium to a uniform electric potential;

a light scanning unit to form an electrostatic latent image on the photosensitive medium;

a developing unit to develop a toner image on a printable medium by applying a toner to the electrostatic latent image; and a charging roller cleaning device to clean the charging roller, wherein the charging roller cleaning device comprises:

a cleaning roller arranged to rotate along with the charging roller, while contacting the charging roller so as to remove impurities attached on the charging roller;

a cleaning member arranged to scrape off impurities attached on the cleaning roller;

a blocking member located between the cleaning member and the charging roller, to block the impurities that are scattered by the cleaning member so as not to contaminate the charging roller, wherein the blocking member is formed of a material having lower elasticity than the material forming the cleaning member.

6. The image forming apparatus of claim 5, further comprising:

a housing, in which the cleaning member is installed, forming a first receiving space receiving the impurities.

7. The image forming apparatus of claim 6, wherein the blocking member is arranged relative to the cleaning member so as to form a second receiving space between the cleaning member and the block member for receiving the impurities with an outer circumference of the cleaning roller and the housing.

8. The image forming apparatus of claim 6, wherein the cleaning member is installed so that a front edge of the cleaning member contacting the outer circumference of the cleaning roller is angled towards a forward direction of rotation of the cleaning roller.

9. The image forming apparatus of claim 6, wherein the developing unit develops the electrostatic latent image using a two-component developing method.

10. The image forming apparatus of claim 6, wherein the cleaning member is a thin plate-shape member formed of one of a rubber, a polyethylene terephthalate (PET), and a urethane, and the blocking member is a thin plate-shape member formed of the same material as the material forming the cleaning member.

11. A removable cartridge for use in an image forming apparatus to remove impurities attached on a charging roller disposed in the image forming apparatus, the removable cartridge comprising:

a housing;

a cleaning roller disposed in the housing to rotate along with the charging roller, while contacting the charging roller so as to remove the impurities on the charging roller;

a cleaning member disposed in the housing to scrape off impurities attached on the cleaning roller; and a blocking member disposed between the cleaning member and the charging roller, to block the impurities that are scattered by the cleaning member, so as not to contaminate the charging roller, wherein the cleaning member is formed of one of a rubber, a polyethylene terephthalate (PET), and a urethane, and the blocking member is formed of a material having lower elasticity than the material forming the cleaning member.

12. The removable cartridge of claim 11, wherein the cleaning member is a thin plate-shaped member having a rear edge supported by the housing and a front edge in contact with the outer circumference of the cleaning roller, and is arranged at an angle toward a rotating direction of the cleaning roller so as to form a receiving space in the housing for receiving the impurities removed from the charging roller.

13. The removable cartridge of claim 11, wherein the blocking member is a thin plate-shaped member having a rear edge supported by the housing and a front edge in proximity with the outer circumference of the cleaning roller, and is arranged at an angle toward a rotating direction of the cleaning roller so as to form a receiving space in the housing for receiving the impurities scattered from the cleaning member.

14. The removable cartridge of claim 11, wherein the cleaning member is installed so that a front edge of the cleaning member contacting the outer circumference of the cleaning roller is angled towards a forward direction of rotation of the cleaning roller.

15. The removable cartridge of claim 11, wherein the blocking member is formed of one of a rubber, a polyethylene terephthalate (PET), and a urethane.

* * * * *